US008991924B2

(12) United States Patent
Piretti

(10) Patent No.: US 8,991,924 B2
(45) Date of Patent: Mar. 31, 2015

(54) CHAIR WITH TILTING BACKREST

(75) Inventor: Alessandro Piretti, Bologna (IT)

(73) Assignee: PRO-CORD S.p.A., Bologna (IT)

( * ) Notice: Subject to any disclaimer, the term of this patent is extended or adjusted under 35 U.S.C. 154(b) by 349 days.

(21) Appl. No.: 13/414,559

(22) Filed: Mar. 7, 2012

(65) Prior Publication Data

US 2012/0228911 A1 Sep. 13, 2012

(30) Foreign Application Priority Data

Mar. 8, 2011 (IT) ..... TO2011A0204

(51) Int. Cl.
*A47C 3/00* (2006.01)
*A47C 7/44* (2006.01)
*A47C 3/12* (2006.01)

(52) U.S. Cl.
CPC ... *A47C 7/44* (2013.01); *A47C 3/12* (2013.01); *A47C 7/445* (2013.01)
USPC ..... 297/285

(58) Field of Classification Search
CPC ..... A47C 3/12; A47C 7/44
USPC ..... 297/452.15, 285
See application file for complete search history.

(56) References Cited

U.S. PATENT DOCUMENTS 4,580,836 A * 4/1986 Verney ..... 297/296
4,585,272 A * 4/1986 Ballarini ..... 297/284.3
4,856,846 A 8/1989 Lohmeyer
4,892,356 A * 1/1990 Pittman et al. ..... 297/452.15
5,320,410 A * 6/1994 Faiks et al. ..... 297/296
5,340,197 A * 8/1994 Vogtherr ..... 297/452.12
5,538,326 A * 7/1996 Lorbiecki ..... 297/452.15
7,118,177 B2 * 10/2006 Piretti ..... 297/296

FOREIGN PATENT DOCUMENTS

EP 2110051 A1 10/2009

* cited by examiner

*Primary Examiner* — David R Dunn
*Assistant Examiner* — Alexander Harrison
(74) *Attorney, Agent, or Firm* — Patterson & Sheridan, L.L.P.

(57) ABSTRACT

A chair with a tilting backrest including two flexible supporting sectional elements set at a distance from one another in a transverse direction, wherein each of said supporting sectional elements is provided with a plurality of through notches that form respective points of localized bending that enable bending backwards of the supporting sectional element, and wherein each of said notches has a first contact surface and a second contact surface that, in the position of maximum inclination backwards of the backrest, come to bear upon one another to stop bending backwards of the sectional element, wherein the projections of said first and second contact surfaces in a vertical plane parallel to the longitudinal axis of the chair are at least partially superimposed on one another in such a way as to prevent visual communication through said notches in a direction orthogonal to said vertical plane.

5 Claims, 5 Drawing Sheets

CHAIR WITH TILTING BACKREST

CROSS-REFERENCE TO RELATED APPLICATIONS

This application claims benefit of Italian patent application serial number TO2011A000204, filed Mar. 8, 2011, which is herein incorporated by reference.

BACKGROUND OF THE INVENTION

1. Field of the Invention

The present invention relates to a chair with a tilting backrest comprising two flexible supporting sectional elements that can undergo elastic deformation under a thrust backwards applied by the user.

2. Description of the Related Art

The document No. EP-A-2110051 filed in the name of the present applicant describes a chair with a tilting backrest, comprising two ribbed supporting sectional elements set at a distance from one another in a transverse direction and connected to a base by means of a transverse supporting element, wherein each of the ribbed supporting sectional elements is substantially L-shaped, with a seat portion, a backrest portion, and a rounded portion for radiusing between the seat portion and the backrest portion. A material substantially in the form of a sheet extends between said supporting sectional elements and forms a seat and a backrest. Each of said ribbed supporting sectional elements is provided with a plurality of through notches set at a distance from one another that form respective points of localized deflection that enable a deflection of the supporting sectional element in a vertical plane. The notches have opposite surfaces that come into contact with one another in the position of maximum inclination so as to limit the maximum amount of bending backwards of the sectional element.

Another type of chair with tilting backrest is described in the document No. U.S. Pat. No. 4,856,846, which illustrates an elastically compliant backrest that comprises some transverse ribbings that are separated from one another by spaces and that are connected to one another by connectors in such a way that the ribbings can turn with respect to one another about horizontal axes.

One of the drawbacks of the chairs of a known type is that the through notches that close during bending backwards of the backrest could pinch the user or his/her garments. Moreover, the open space of the notches is visible in a transverse direction and gives the impression that the notches are dangerous points of failure.

SUMMARY OF THE INVENTION

The object of the present invention is to provide a chair that will enable the drawbacks of the prior art to be overcome and that will have a styling that is more technically valid and solid as compared to chairs of a known type.

According to the present invention, the above object is achieved by a chair having the characteristics forming the subject of claim 1.

BRIEF DESCRIPTION OF THE DRAWINGS

The present invention will now be described in detail with reference to the attached drawings, which are provided purely by way of non-limiting example and in which.

DETAILED DESCRIPTION

Figure 1:
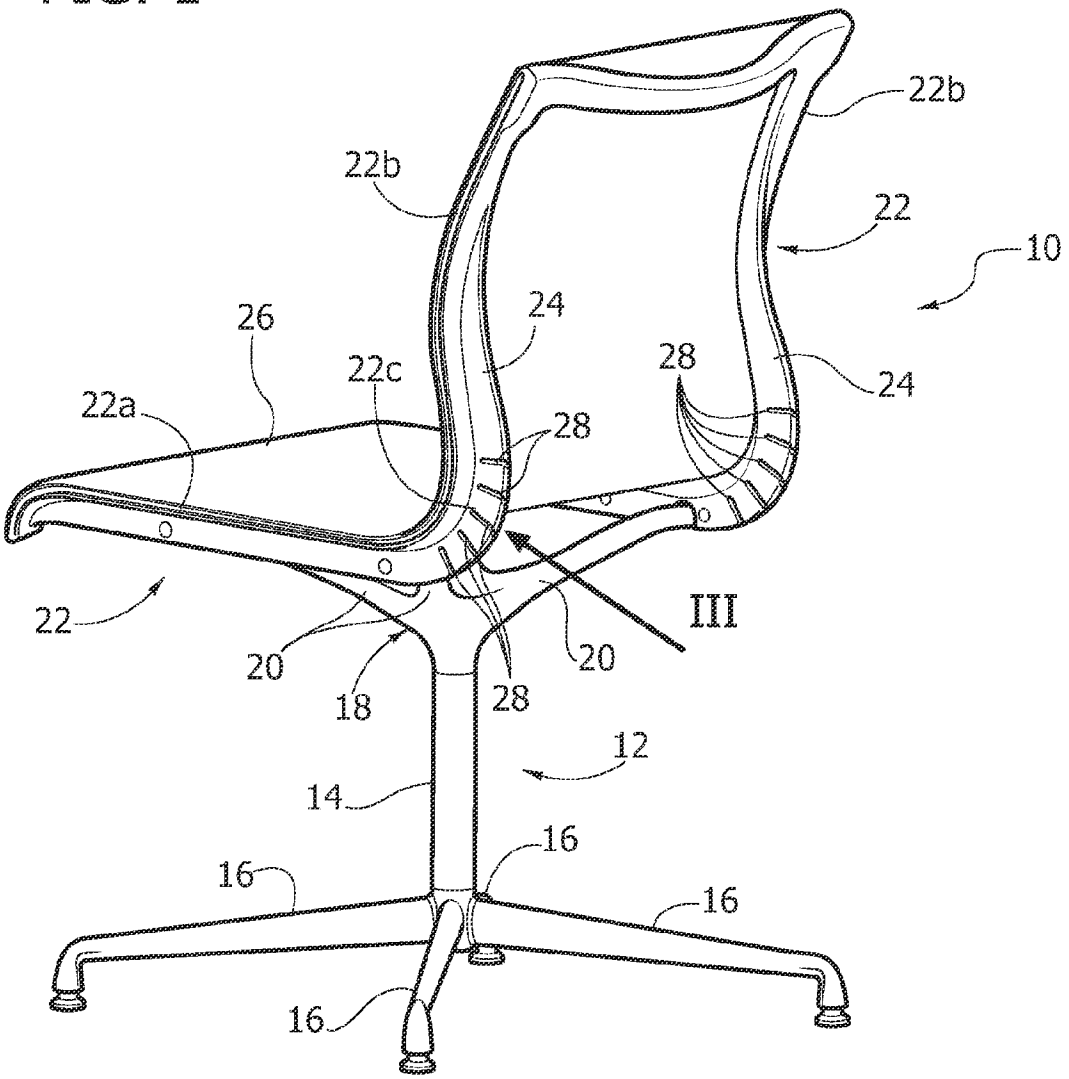
FIGS. 1 and 2 are, respectively, a perspective view and a side view of a first embodiment and a second embodiment of a chair according to the present invention.

With reference to FIG. 1, designated by 10 is a chair according to a first embodiment of the present invention. The chair 10 comprises a base structure 12 including a vertical upright 14 that rests on the floor by means of a plurality of radial arms 16. The central upright 14, which is possibly height-adjustable, carries at its top end a support 18, provided, for example, with two pairs of radial arms 20.

The chair 10 comprises two supporting sectional elements 22 forming the lateral edges of the chair 10, fixed to the outer ends of the radial arms 20. The two supporting sectional elements 22 are parallel to and set at a distance from one another in a transverse direction. The two supporting sectional elements 22 are preferably specular, and each of them is substantially L-shaped, with a seat portion 22*a*, a backrest portion 22*b*, and an arched radiusing portion 22*c*, which extends between the seat portion 22*a* and the backrest portion 22*b*.

Each supporting sectional element 22 is preferably constituted by a monolithic element made of injection-moulded plastic material. Each supporting sectional element 22 is provided with a ribbing 24 that extends in a vertical plane, obtained integrally with the respective supporting sectional element 22. The ribbing 24 extends along the radiusing portion 22*c* and on at least one part of the seat portion 22*a* and of the backrest portion 22*b*. The ribbing 24 extends on the underside of the seat portion 22*a* and on the rear side of the backrest portion 22*b*.

In the embodiment of FIG. 1, the chair 10 comprises a flexible sheet 26 of fabric, mesh, or the like, which is stretched between the two lateral supporting sectional elements 22 and forms the seat and the backrest of the chair. The lateral edges of the flexible sheet 26 can be fixed within respective external grooves of the supporting sectional elements 12, as described in the document EP-A-2110051 filed in the name of the present applicant.

Figure 3:
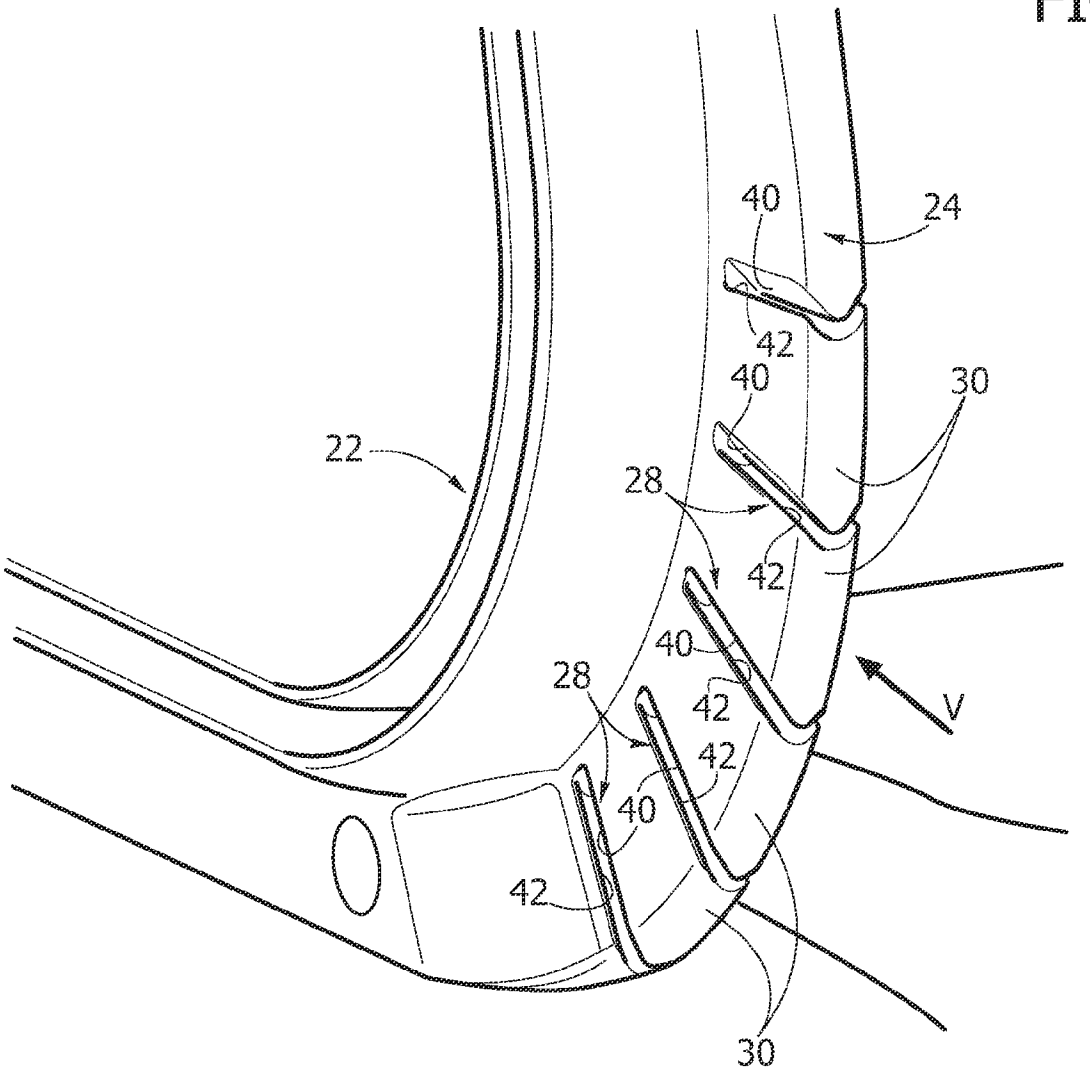
FIGS. 3 and 4 are enlarged perspective views of the parts indicated, respectively, by the arrows III and IV in FIGS. 1 and 2.

With reference to FIGS. 1 and 3, the ribbing 24 of each supporting sectional element 22 is provided with a plurality of through notches 28 set at a distance from one another along the longitudinal axis of the ribbing 24. The notches 28 form respective points of localized bending of the supporting sectional elements 22. At each notch 28, the supporting sectional element 22 is able to perform a movement of bending. The notches 28 are set apart in a longitudinal direction by stretches 30 in which the ribbing 24 is continuous. The supporting sectional element 22 in the stretches 30 is basically stiff in regard to movements of bending in a vertical plane. The notches 28 form hinge points between substantially stiff contiguous sections of the supporting sectional element 22.

The supporting sectional elements 22 are elastically deformable backwards under a thrust applied by the back of the user. The backrest oscillates backwards thanks to bending of the supporting sectional elements 22 at the notches 28. Return from the bent position to the resting position occurs as a result of the elastic return of the material constituting the supporting sectional elements 22.

Figure 2:
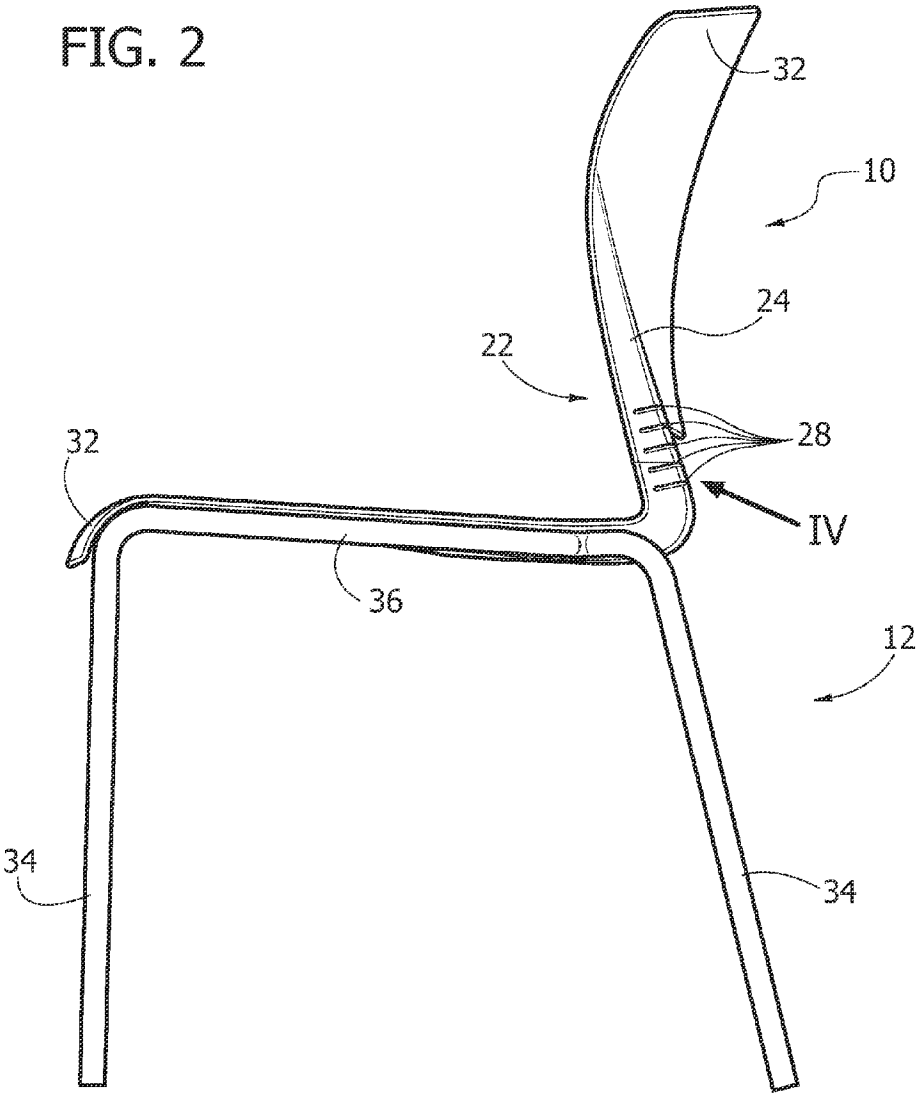
Figure 4:
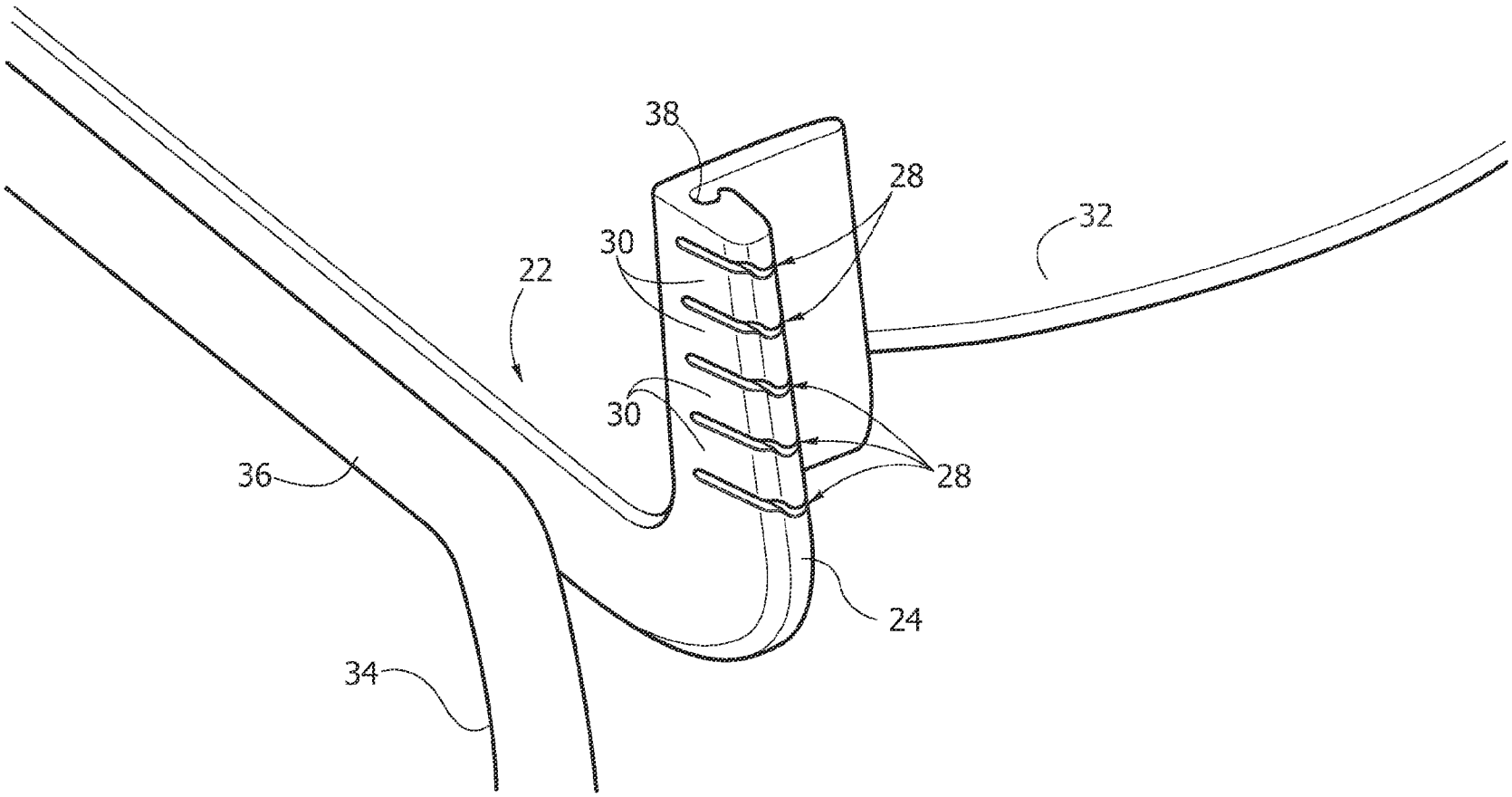

FIGS. 2 and 4 illustrate a second embodiment of the chair 10 according to the present invention. The elements corresponding to the ones described previously are designated by the same reference numbers.

In this case, the seat and the backrest of the chair 10 are formed by a shaped thin plate 32 of injection-moulded plastic material, formed integrally with the lateral supporting sectional elements 22. Also in this case, the supporting sectional elements 22 are provided with respective ribbings 24 provided with notches 28 that form points of localized bending of the supporting sectional elements 22.

In the variant of FIGS. 2 and 4 the base structure 12 of the chair 10 can be formed by a metal frame with four legs 34, having two lateral elements 36, fixed to which are the respective supporting sectional elements 22.

Shown in FIG. 4 is a seat 38 formed at the base of the ribbing 24, in which there can be housed an elastic member, constituted for example by a bar of metal material with high elasticity (for example, spring steel) for enhancing the characteristics of elastic return of the supporting sectional element 22.

The elastic member can of course also be provided in the embodiment of FIG. 1. In this case, the elastic member can be housed in a seat made in the same groove as the one in which the edge of the fabric is inserted.

Figure 7:
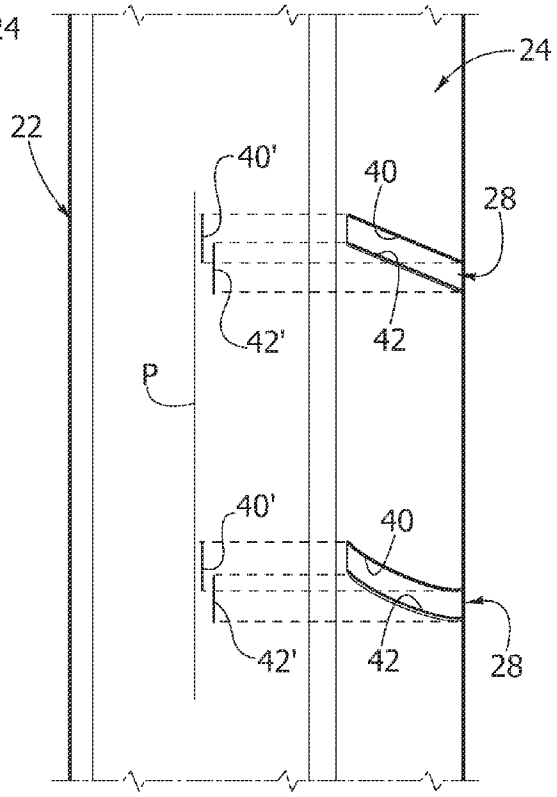
FIGS. 5, 6 and 7 are front and rear views according to the arrow V of FIG. 3 illustrating various possible shapes of the notches.
Figure 6:
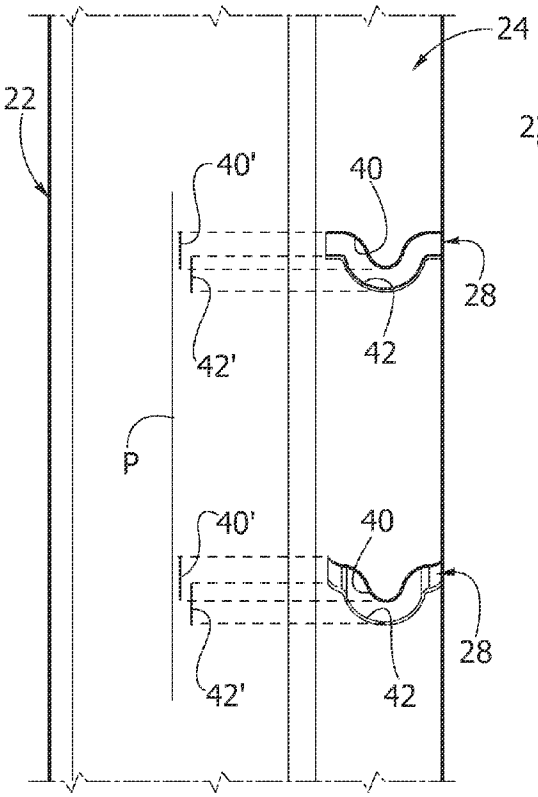
Figure 5:
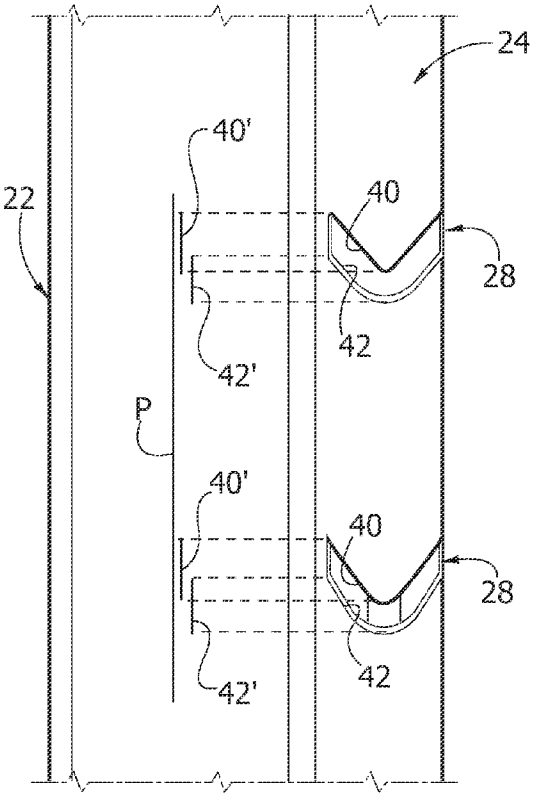

FIGS. 5, 6 and 7 illustrate some possible shapes of the notches 28. Each notch 28 has a first contact surface 40 and a second contact surface 42. In the position of maximum inclination backwards of the backrest the first and second contact surfaces 40, 42 come to bear on one another to stop bending backwards of the sectional element 24.

Designated by P in FIGS. 5-7 is the trace of a vertical plane parallel to the longitudinal axis of the chair. The projections of the contact surfaces 40, 42 in the plane P are designated by 40' and 42', respectively.

The shape of the notches 28 is such that the projections 40', 42' of the first and second contact surfaces 40, 42 in the plane P are at least partially superimposed on one another. In this way, a visual communication through the notches 28 in a direction orthogonal to the plane P is prevented.

The shape of the contact surfaces 40, 42 may present numerous variants. By way of example, in FIGS. 5, 6 and 7 notches 28 are shown, the contact surfaces 40, 42 of which in a plane orthogonal to said plane P are substantially V-shaped, Ω-shaped, and shaped like an inclined bar. The shapes illustrated in FIGS. 5-7 are to be considered merely as non-exhaustive examples. For the purposes of the present invention, any other shape of the notches that produces an at least partial superposition of the projections 40', 42' can be used.

This shape of the notches enables considerable reduction of the risk of squeezing or pinching for the user. At the same time, the aesthetic appearance of the chair is improved in so far as the notches no longer have the appearance of dangerous points of failure. The fact that it is not possible to see through the notches bestows upon the chair an appearance that is more technically valid and sturdy.

A chair that uses the notches described in the present application can be provided also in ways alternative to the ones illustrated in FIGS. 1-7.

The seat, the backrest, and the elastic joints (provided with the notches) may not be moulded integrally.

Alternatively, the seat and backrest could be discrete components; the notches could be made in portions of just the seat, just the backrest, or both of them.

While the foregoing is directed to embodiments of the present invention, other and further embodiments of the invention may be devised without departing from the basic scope thereof, and the scope thereof is determined by the claims that follow.

The invention claimed is:

1. A chair with a tilting backrest including two flexible supporting sectional elements set at a distance from one another in a transverse direction, wherein each of said supporting sectional elements is provided with a plurality of through notches that form respective points of localized bending that enable a bending backwards of the supporting sectional element, wherein each of said notches has an upper contact surface and a lower contact surface that, in the position of maximum inclination backwards of the backrest, come to bear upon one another to stop bending backwards of the sectional element, wherein an upper-most portion of the lower contact surface has an elevation above a lower-most portion of the upper contact surface so as to prevent visual communication therethrough.

2. The chair according to claim 1, wherein said notches are formed in an integral ribbing that extends in a vertical plane.

3. The chair according to claim 1, wherein said upper and lower contact surfaces in a plane orthogonal to said vertical plane are substantially V-shaped.

4. The chair according to claim 1, wherein said upper and lower contact surfaces in a plane orthogonal to said vertical plane are substantially Ω-shaped.

5. The chair according to claim 1, wherein said upper and lower contact surfaces in a plane orthogonal to said vertical plane are shaped like inclined bars.

* * * * *